United States Patent [19]

Wojcinski

[11] Patent Number: 4,458,901

[45] Date of Patent: Jul. 10, 1984

[54] BACKSTOP (TARGET)

[76] Inventor: Allan S. Wojcinski, Bonifatiusstr. 88, 4000 Düsseldorf 1, Fed. Rep. of Germany

[21] Appl. No.: 406,040

[22] Filed: Aug. 6, 1982

[30] Foreign Application Priority Data

Aug. 6, 1981 [DE] Fed. Rep. of Germany ..... 3131228

[51] Int. Cl.[3] ..... F41J 1/12

[52] U.S. Cl. ..... 273/410

[58] Field of Search ..... 273/404, 410; 73/167

[56] References Cited

U.S. PATENT DOCUMENTS

| | | | |
|---|---|---|---|
| 2,201,527 | 5/1940 | Freeman | 273/404 X |
| 2,420,304 | 5/1947 | Diem | 273/410 X |
| 2,772,092 | 11/1956 | Nikoden | 273/410 |
| 2,818,729 | 1/1958 | Ferguson | 73/167 |
| 3,701,532 | 10/1972 | Nikoden | 273/410 |
| 3,720,411 | 3/1973 | De Vogelaere | 273/404 |

FOREIGN PATENT DOCUMENTS

| | | | |
|---|---|---|---|
| 500781 | 6/1930 | Fed. Rep. of Germany | 273/410 |
| 858951 | 12/1952 | Fed. Rep. of Germany | 273/404 |
| 17036 | of 1902 | United Kingdom | 273/404 |

*Primary Examiner*—Paul E. Shapiro

*Attorney, Agent, or Firm*—Fleit, Jacobson, Cohn & Price

[57] ABSTRACT

A target back-stop behind a target area with lamellar rows of lamellae mounted at a distance from one another while the lamellae of a front row of lamellae form a predetermined angle $\alpha_1$ with the normal of the target area, and while the lamellae of a rear row of lamellae form, in the opposite direction, a predetermined angle $\alpha_2$ to the normal of the target area. A front end of one lamella of the rear row of lamellae borders on the rear end of one lamella of the front row of lamellae, so that channels will be formed that zigzag between the lamellae, and in which projectiles of widely varying caliber will shuttle to and fro and, in that way, will be braked.

17 Claims, 4 Drawing Figures

BACKSTOP (TARGET)

Figure 1:
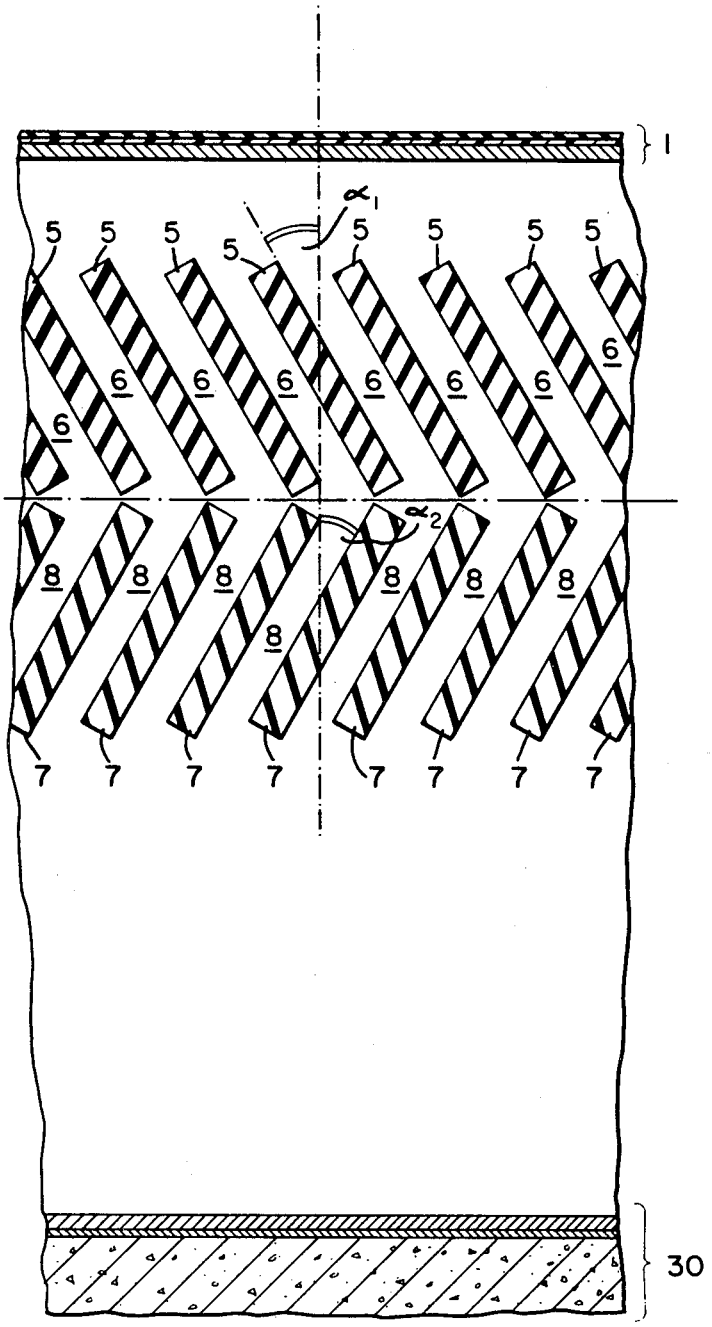

The present invention is concerned with a target back-stop in accordance with the description in Patent claim 1.

A target back-stop is known from the German Patent Application (laid open for inspection) No. 28 39 509; in it, there have been provided, behind the target surface, several butt plates which, e.g., are made of a hard rubber material. These butt plates are suspended, so as to hang freely, from the ceiling of the room, parallel to one another and at a distance from one another, one behind the other.

One disadvantage of such a known target back-stop is to be found in the hact that it has a relatively short life, because the projectiles penetrate preponderantly at one spot, which leads to a shooting-out of material at that spot. That applies particularly to the back-stop plates in front.

The task of the present invention consists in presenting a target back-stop that has a longer life than the known back-stop as described above. That problem is solved by a back-spot of the type mentioned at the outset, that is characterized by the characteristics listed in the characterizing part of Patent claim 1.

An essential advantage of the present invention is to be found in the fact that projectiles hitting the individual lamellae will not penetrate them, but will wobble to and fro between them and will fall to the ground after they have been braked. It is an advantage that the life of the back-stop is very long, because many projectiles will not penetrate the individual lamellae of the back-stop. Advantageously, in the back-stop in accordance with the invention, some 80% of the projectiles are braked, in such a way that they will fall to the ground. Only 20% get stuck.

Advantageously, a back-stop in accordance with the invention is capable of receiving up to 50,000 projectiles per $m^2$.

An additional essential advantage of the present invention is to be found in the fact that no lead dust will arise, as is the case particularly with steel-ball back-stops in which the projectiles hit steel surfaces directly. It is therefore possible, by the use of the back-stop in accordance with the invention, to prevent high lead levels which are harmful to one's health, within the environment of the back-stop.

Advantageously, the back-stop in accordance with the invention is suitable for the widely varying calibers of hand fire-arms, sporting guns and police weapons.

A further important advantage of the present invention consists in the fact that the incoming projectiles, due to the arrangement of the lamellae, cause but little noise. The sound emission of the back-stops in accordance with the invention is extremely low. Advantageously, no sound is transmitted to the walls surrounding the back-stop, on which it is mounted, and, if such be the case, to any circuits existing in said walls.

A very essential advantage of the present invention may be seen in the fact that the individual lamellae can be exchanged very easily and rapidly. For that reason, it is much simpler to service the back-stop in accordance with the invention than any known back-stops. Advantageously, a high ricochet safety exists in the back-stop in accordance with the invention.

Figure 2:
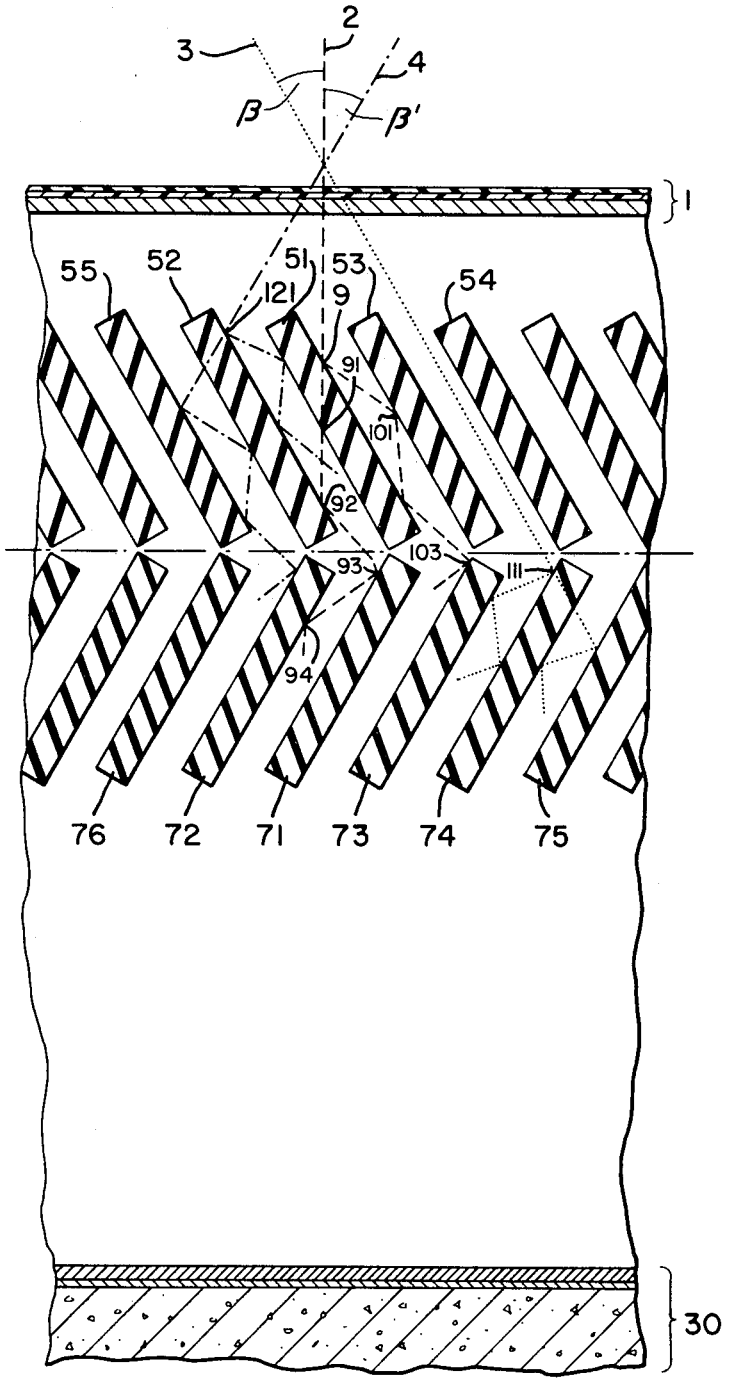
Figure 3:
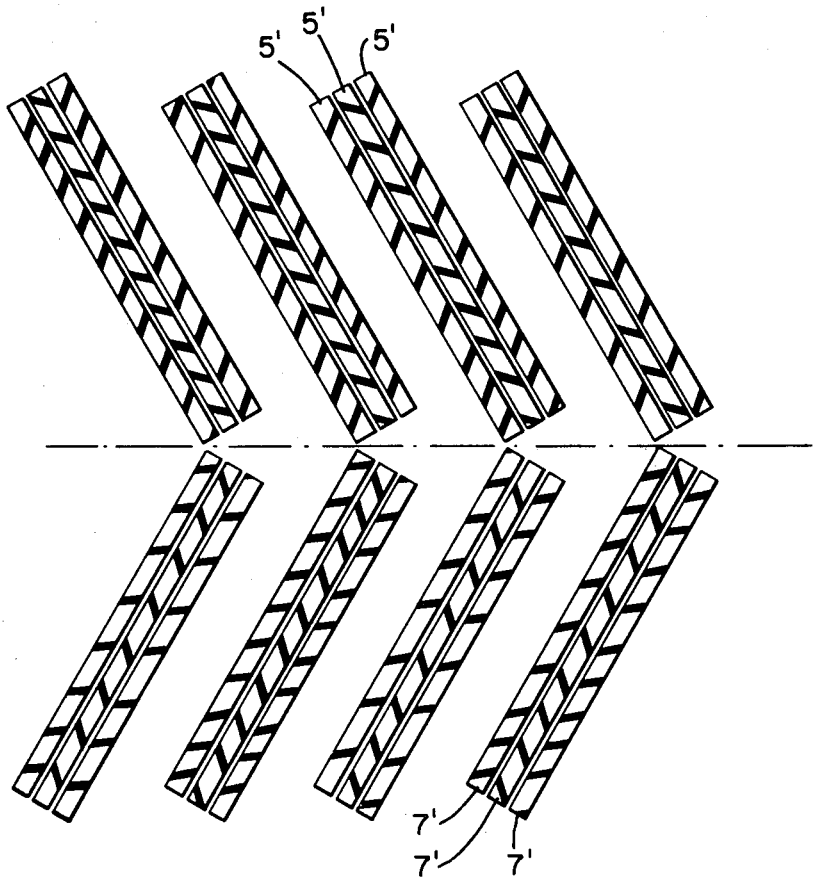
Figure 4:
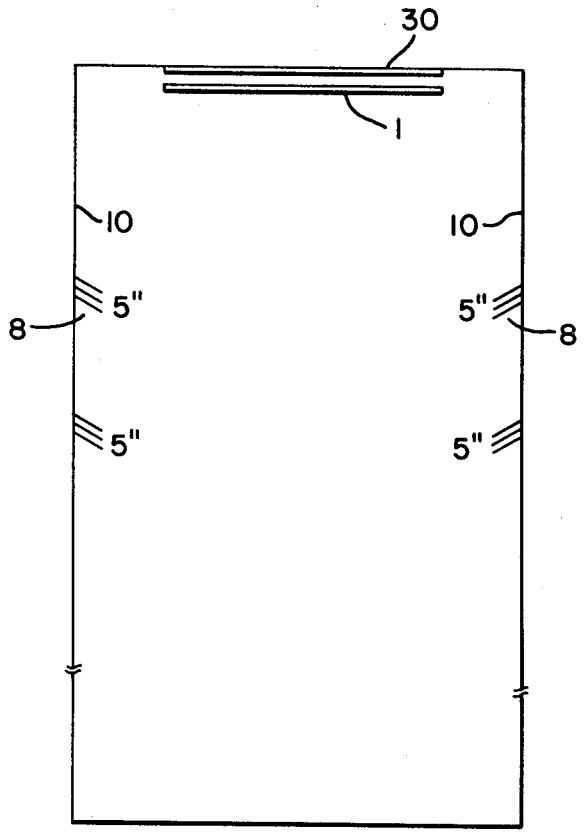

In the following, the invention and its designs will be explained in greater detail, in connection with the drawings. We present in:

FIGS. 1 and 2 a back-stop in accordance with the invention,

FIG. 3 a further development of the back-stop in accordance with the invention, and in FIG. 4 another further development of the invention.

In FIG. 1 which shows a top-view on the section of a back-stop in accordance with the invention, the target surface has been designated by 1. E.g., this target surface 1 consists of a steel frame on which, a Regupol layer has been mounted as rear layer, and a rubber sheet has been mounted as front layer. On the rubber sheet, a non-drying plastic paste may be provided that makes it easy, following a series of shots to recognize the group of hits and subsequently may be wiped by means of a wiper or similar device.

Behind the target surface, two rows of lamellar plates 5, 7 are mounted in the manner as shown in FIG. 1; they consist, preferably, of hard rubber. In particular, the lamellar plates consist of a material of six layers of hard rubber with mats of plastic material or wire netting placed inside it. The row of lamellae 5 and 7 are arranged, in the manner shown in FIG. 1, at an inclination in relation to the target surface 1. E.g., the front lamellae 5 are arranged, in such a way that they from an angle $\alpha_1$ with the normal of the target surface 1. The lamellar plates 7 of the rear row form, e.g., and angle $\alpha_2$ to the normal of the target surface 1. The angles $\alpha_1$ and $\alpha_2$ run in opposite directions. Preferably, the angles $\alpha_1$ and $\alpha_2$ are of the same magnitude and amount to some 20° to 40°. Preferably, the angles $\alpha_1$ and $\alpha_2$ amount to some 25° or 30°. E.g., the lamellar plates 5 in front are inclined by the angle $\alpha_1$ in relation to the normal of the target surface 1, toward the left, while the lamellar plates 7 in the rear are inclined by the angle $\alpha_2$ in relation to the normal of the target surface 1, toward the right.

The lamellar plates 7 in the rear are arranged preferably, in such a way that, in each case, the front end of a rear lamellar plate 7 abuts the rear end of a frontal lamellar plate 5. In that way, channels 6, 8 of a zig-zag shape come into existence between the front row of the lamellar plates and the rear row of the lamellar plates, as has been shown in FIG. 1; in those channels, the incoming projectiles wobble to and fro. During that process, they are braked largely, to such an extent that they will fall to the ground, vertically to the drawing plane (Zeichenebene). Behind the back-stop, a space has been provided for checking the state of the back-stop and for the removal of the projectiles.

A rear wall 30 is provided, by preference, at a distance from the lamellar plates 7 in the rear. The distance of that rear wall 30, which consists preferably of steel plates, is determined by the type of projectile, by its energy, and by similar factors.

A steel wall 30 is particularly advantageous, when the use of projectiles is included which, on the basis of their weight, their energy, and their design, may be able to pass through the rows of lamellae and reach the rear wall.

In the following, the progress of projectiles arriving from various firing directions 2 to 4 will be described, on the basis of FIG. 2. E.g., a projectile moving in the direction of the normal 2 of the target surface 1, hits a front lamellar plate 51 in point 9. When the impact of the projectile is sufficiently strong, it may happen that the projectile will penetrate the front lamellar plate 51 in the point 9 and leaves the front lamellae plate 51 in the point 91. During the penetration of the front lamellar plate 51, the projectile is braked considerably. It will then arrive in the channel formed by the front lamellar plates 51 and 52 and the rear lamellar plates 71 and 72, and will wobble, e.g., between the front lamellar plates 51,52 and the rear lamellar plates 71,72, to and fro (points 91 to 94), until such a time as it has been braked, to such an extent that it will fall vertically downward on the ground. When the strength of the impact of the projectile coming from the direction 2 is not sufficiently great for it to be able to penetrate the front lamellar plate 51 in the point 9, the projectile will wobble in the channel formed by the front lamellar plates 51 and 53 and the rear lamellar plates 71 and 73, to and fro (points 9 and 101 to 102). When the projectile has been braked sufficiently, it will fall vertically downward.

A projectile that hits from the firing direction 3 at an angle of to the normal, e.g. passes through the channel formed by the front lamellar plates 53 and 54 and strikes the rear lamellar plate in the point 111. If the projectile penetrates the lamellar plate 74 in the point 111, it will wobble to and fro within the channel that is formed by the rear lamellar plates 74 and 75. If the projectile is deflected in the point 111 and does not penetrate the rear lamellar plate, it will wobble to and fro within the channel between the rear lamellar plates 73 and 74.

A projectile that hits from the firing direction 4 at an angle of to the normal, strikes, e.g., the front lamellar plate 52 in the point 121. As the case may be, viz. whether it does or does not penetrate the front lamellar plate 52 in the point 121, it will subsequently wobble either in the channel that is formed by the front lamellar plates 52 and 55 and the rear lamellar plates 72 and 76, or in the channel that is formed by the front lamellar plates 51 and 52 and the rear lamellar plates 71 and 72, to and fro.

At an angle of impact not exceeding 25°, the ricochet safety of the striking projectile is ensured.

In the following, an example of the embodiment of the invention, inasmuch as the dimensions of the various lamellae are concerned, will be given. By preference, the width of those lamellae amounts to some 25 cm, while the thickness amounts to some 20 mm. The distance between the various lamellae amounts to some 30 mm.

By preference, the individual lamellar plates in the front and the individual lamellar plates in the rear auspended in each case so as to swing freely.

In a further devlopment of the present invention—as is evident from FIG. 3—the individual lamellar plates in the front and in the rear are subdivided into several partial plates (5), (7) that are parallel, preferably into three parallel partial plates. In this case, preferably the upper ends of the partial plates forming one lamellar plate each are fastened together and suspended on a ceiling or on a frame provided to that end. An advantage of this further development of the invention is the fact that the thickness required by one lamellar plate is achieved by arranging several partial plates, which are more easily available. parallel to one another. An additional advantage consists in the fact that the servicing of a back-stop of this kind is facilitated, inasmuch as in most cases not the entire lamellar plates, but only the frontal partial plates of the lamellar plates that are facing the marksman, will have to be replaced. That makes it possible to save expenses. Projectiles that enter a lamellar plate that consists of several parallel partial plates, may, e.g., after they have penetrated the partial plate in the front, may wobble to and fro in the space between the frontal partial plate and the next following one, and may be braked in that way. The thickness of the individual partial plates may amount, e.g., to 10 mm.

Test results have demonstrated that back-stops in accordance with the invention are suitable effectively to brake projectiles of wisely varying calibers that have been fired from hand guns or from rifles or carbines.

In FIG. 4 a further development of the invention is shown, in which lamellar plates 52' are mounted on the lateral walls 10 of a shooting gallery, at a distance from one another, in front of the back-stop or the target surface 1, in such a way that projectiles striking them will be directed into the space between the various lamellar plates in the direction of the lateral wall and braked, at the same time. In the way that is evident from FIG. 4, the various lamellar plates are preferably arranged on the lateral wall, in such a way that they form an angle with the lateral wall, said angle being determined by the dimensions of the shooting gallery. In particular, it is advantageous to mount such lamellar plates 52' on the lateral walls 10 of a shooting gallery within the region of the target area 1.

I claim:

1. Target back-stop in which, behind a target surface, separate devices for braking the projectiles, characterized by the fact that the devices consist of series of lamellae that are arranged behind one another, in such a way that the lamellae of the first series (row) of lamellae are inclined, by a predetermined angle ($\alpha 1$) in one direction in relation to the normal of the target surface, and that the lamellae of the second row of lamellae are inclined at an angle ($\alpha 2$) in the opposite direction in relation to the normal of the target surface, that the individual lamellae of the lamellae rows are placed at a distance to one another, and that the front end of one lamella each of the second row of lamellae abuts upon the rear end of one lamella each of the first row of lamellae, that zigzagged channels will be formed between the lamellae.

2. Target back-stop in accordance with claim 1, characterized by the fact that two rows of lamellae are provided.

3. Target back-stop in accordance with claim 2, characterized by the fact that the predetermined angle ($\alpha 1$) between the lamellae of the first row of lamellae and the normal to the target surface and the predetermined angle ($\alpha 2$) between the lamellae of the second row of lamellae and the normal to the target surface are of the same magnitude.

4. Target back-stop in accordance with claim 3, characterized by the fact that the angle ($\alpha 1$) between the lamellae of the first row of lamellae and the normal to the target surface amount to from 20° to 40°.

5. Target back-stop in accordance with claim 4, characterized by the fact that the angle ($\alpha 1$) between the lamellae of the first row of lamellae and the normal to the target surface amounts to about 25°.

6. Target back-stop in accordance with claim 5, characterized by the fact that the angle ($\alpha 2$) between the lamellae of the second row of lamellae and the normal to the target surface amounts to from 20° to 40°.

7. Target back-stop in accordance with claim 6, characterized by the fact that the angle ($\alpha 2$) between the lamellae of the second row of lamellae and the normal to the target surface amount to about 25°.

8. Target back-stop in accordance with claim 7, characterized by the fact that the individual lamellae of the row of lamellae are suspended in each case so as to swing freely.

9. Target back-stop in accordance with claim 8, characterized by the fact that the width of the individual lamellae amount to about 25 cm, that the thickness of the individual lamellae amount to about 20 cm, and that the lamellae are placed at a distance of 30 mm from one another.

10. Target back-stop in accordance with claim 9, characterized by the fact that the individual lamellae consist of several partial lamellae that have been arranged parallel to one another, and that the upper ends of the partial lamellae are interconnected by means of fastening devices.

11. Target back-stop in accordance with claim 10, characterized by the fact that the width of the individual partial lamellae amounts to some 25 cm, and that the thickness of the individual partial lamellae amounts to some 10 mm.

12. Target back-stop in accordance with claim 11, characterized by the fact that the individual lamellae have been subdivided into three parallel partial lamellae.

13. Target back-stop in accordance with claim 12, characterized by the fact that the individual lamellae consist of a hard rubber material with synthetic fiber mats that have been poured into it in several layers.

14. Target back-stop in accordance with claim 13, characterized by the fact that the lamellae consist of six layers of hard rubber material.

15. Target back-stop in accordance with claim 4, characterized by the fact that the angle ($\alpha 1$) between the lamellae of the first row of lamellae and the normal to the target surface amounts to about 30°.

16. Target back-stop in accordance with claim 6, characterized by the fact that the angle ($\alpha 2$) between the lamellae of the second row of the lamellae and the normal to the target surface amounts to about 30°.

17. Target back-stop in accordance with claim 1, characterized by the fact that the predetermined angle ($\alpha 1$) between the lamellae of the first row of lamellae and the normal to the target surface and the predetermined angle ($\alpha 2$) between the lamellae of the second row of lamellae and the normal to the target surface are of the same magnitude.

* * * * *